US011588279B2

(12) United States Patent
Li et al.

(10) Patent No.: US 11,588,279 B2
(45) Date of Patent: Feb. 21, 2023

(54) DUAL IN-LINE MEMORY MODULE (DIMM) SOCKET CIRCUIT TO DETECT IMPROPER INSERTION OF A DIMM EDGE INTO A DIMM SOCKET

(71) Applicant: Intel Corporation, Santa Clara, CA (US)

(72) Inventors: Xiang Li, Portland, OR (US); George Vergis, Portland, OR (US)

(73) Assignee: Intel Corporation, Santa Clara, CA (US)

( * ) Notice: Subject to any disclaimer, the term of this patent is extended or adjusted under 35 U.S.C. 154(b) by 296 days.

(21) Appl. No.: 17/031,800

(22) Filed: Sep. 24, 2020

(65) Prior Publication Data

US 2021/0021089 A1 Jan. 21, 2021

(51) Int. Cl.

| | |
|---|---|
| ***H01R 13/62*** | (2006.01) |
| ***H01R 13/66*** | (2006.01) |
| ***H01R 12/73*** | (2011.01) |
| ***H01R 13/635*** | (2006.01) |

(52) U.S. Cl.
CPC ..... *H01R 13/6683* (2013.01); *H01R 12/737* (2013.01); *H01R 13/635* (2013.01)

(58) Field of Classification Search
CPC ..... H10R 13/633; H01R 13/635; G06K 13/08
See application file for complete search history.

(56) References Cited

U.S. PATENT DOCUMENTS 4,165,909 A * 8/1979 Yeager ..... H01R 12/88 439/260
4,189,200 A * 2/1980 Yeager ..... H01R 12/88 439/267
4,487,468 A * 12/1984 Fedder ..... H01R 12/7005 439/325
5,162,979 A * 11/1992 Anzelone ..... G06F 13/409 439/157
5,368,493 A * 11/1994 O'Brien ..... G06K 13/08 439/153
5,536,180 A * 7/1996 Ishida ..... H01R 13/633 439/157
5,655,918 A * 8/1997 Soh ..... H01R 13/635 439/541.5
6,894,722 B1 * 5/2005 Hanzawa ..... H04N 5/772 386/E5.072
10,888,010 B2 1/2021 Geng et al.
10,950,958 B2 3/2021 Geng et al.
(Continued)

FOREIGN PATENT DOCUMENTS

JP 2001068181 A 3/2001

OTHER PUBLICATIONS

International Search Report and Written Opinion for PCT Patent Application No. PCT/US21/47488, dated Dec. 21, 2021, 10 pages.

*Primary Examiner* — Phuong Chi Thi Nguyen
(74) *Attorney, Agent, or Firm* — Compass IP Law PC

(57) ABSTRACT

An apparatus is described. The apparatus includes a dual-in line memory module (DIMM) socket having a first electrical circuit component embedded in a latch of the DIMM socket. The first electrical circuit component has a first exposed electrical contact that is to contact or not contact a second exposed electrical contact of a second electrical circuit component that is embedded in a housing of the socket depending on whether a corner of a DIMM is or is not properly inserted into the DIMM socket.

19 Claims, 9 Drawing Sheets

(56) References Cited

U.S. PATENT DOCUMENTS

| | | | |
|---|---|---|---|
| 2007/0026722 | A1 | 2/2007 | Ringler et al. |
| 2015/0004824 | A1 | 1/2015 | Nguyen et al. |
| 2018/0358727 | A1 | 12/2018 | Li et al. |
| 2019/0165503 | A1 | 5/2019 | Geng et al. |
| 2019/0214750 | A1 | 7/2019 | Pineda |
| 2020/0327912 | A1 | 10/2020 | Li et al. |
| 2020/0388962 | A1 | 12/2020 | Geng et al. |

* cited by examiner

DUAL IN-LINE MEMORY MODULE (DIMM) SOCKET CIRCUIT TO DETECT IMPROPER INSERTION OF A DIMM EDGE INTO A DIMM SOCKET

FIELD OF INVENTION

The field of invention pertains to the electrical-mechanical arts, and, in particular, pertains to a DIMM socket circuit to detect improper insertion of a DIMM edge into a DIMM socket.

BACKGROUND

Increased performance of computing systems is frequently achieved by integrating more signal wires into smaller and smaller form factors. An area of concern is the electro-mechanical coupling of a memory module, such as a dual in-line memory module (DIMM), to a motherboard or other base electronic circuit board. Here, as the distance between I/Os becomes shorter and/or the number of I/Os increases, failure mechanisms of the module/bard attachment are likely emerge.

FIGURES

Figure 1A:
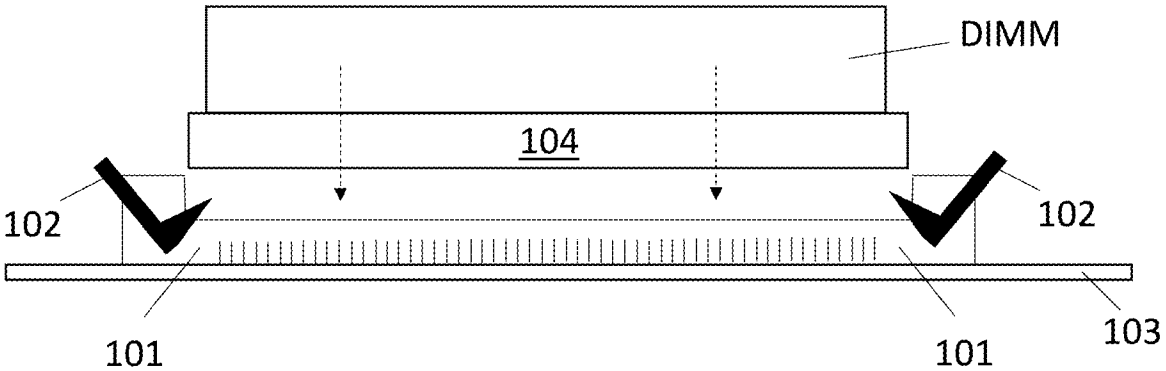
Figure 1B:
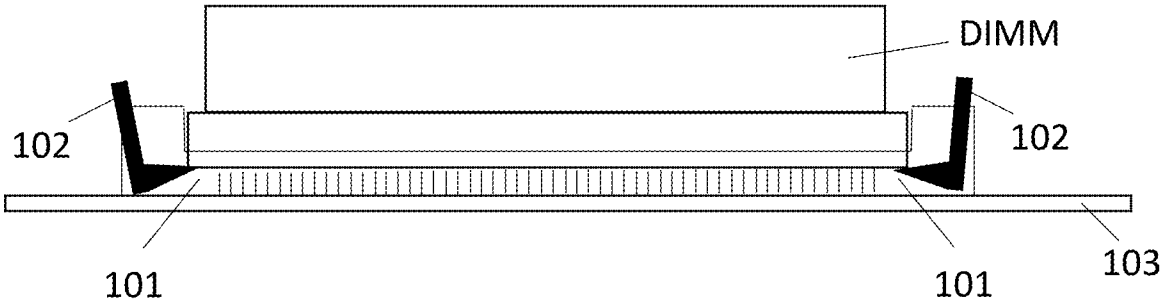
Figure 1C:
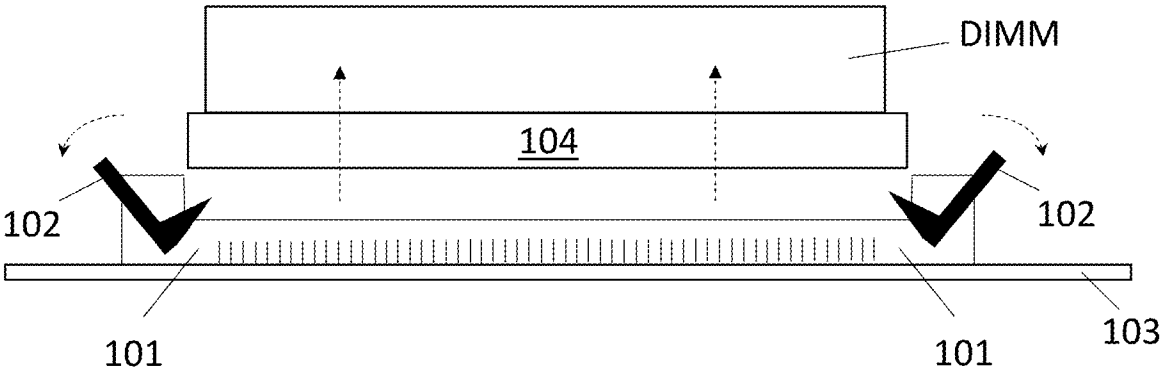
Figure 2:
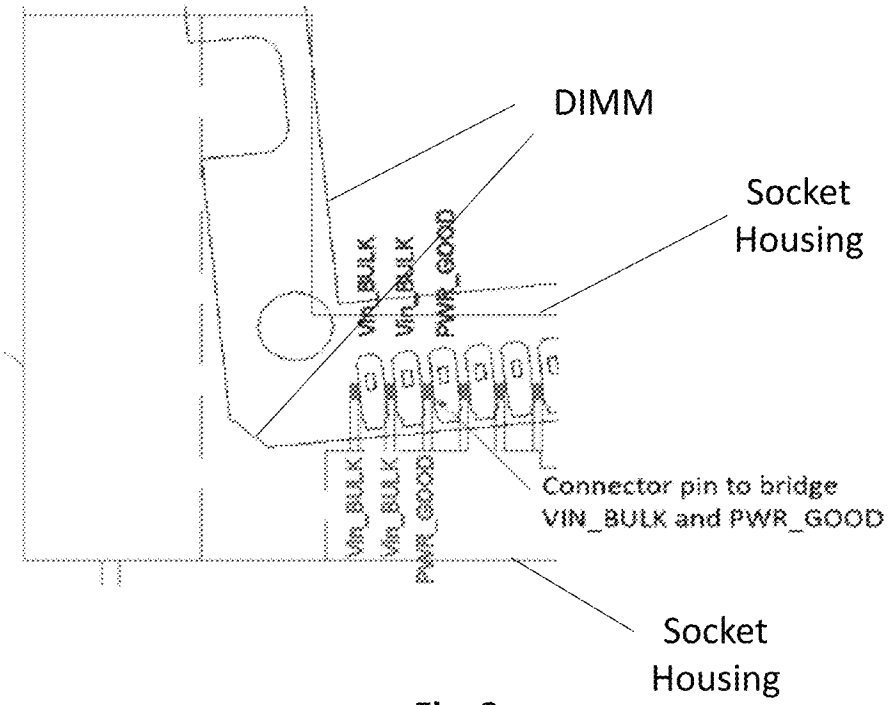
Figure 3A:
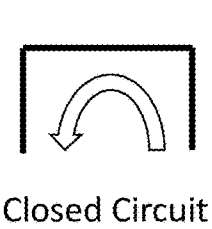
Figure 3A:
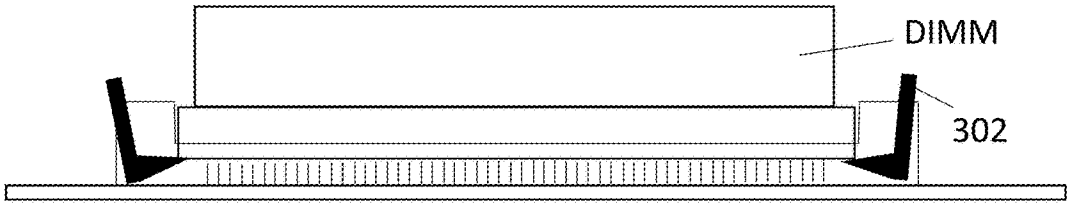
Figure 3B:
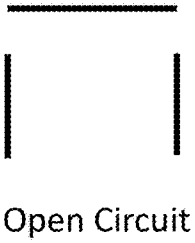
Figure 3B:
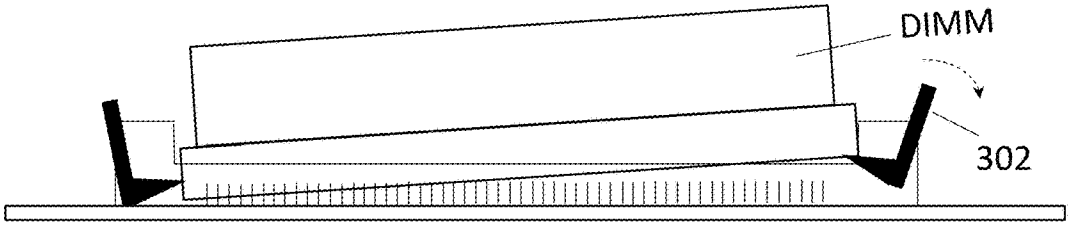
Figure 4B:
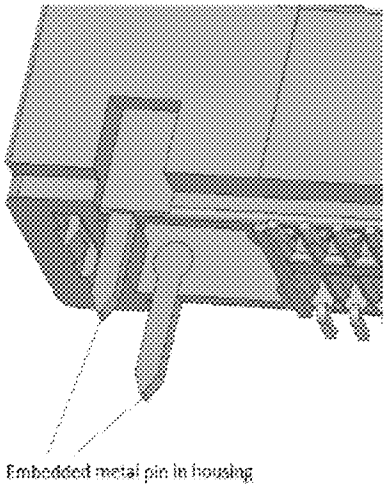
Figure 4A:
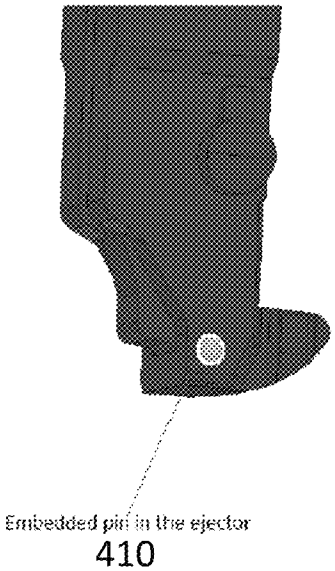

A better understanding of the present invention can be obtained from the following detailed description in conjunction with the following drawings, in which:

FIGS. 1*a*, 1*b* and 1*c* show a standard DIMM/motherboard connection;

FIG. 2 show a problem that can occur with a DIMM/motherboard connection;

FIGS. 3*a* and 3*b* show a solution to the problem of FIG. 2;

FIGS. 4*a* and 4*b* show different components of a DIMM socket to implement the solution of FIGS. 3*a* and 3*b;*

Figure 5A:
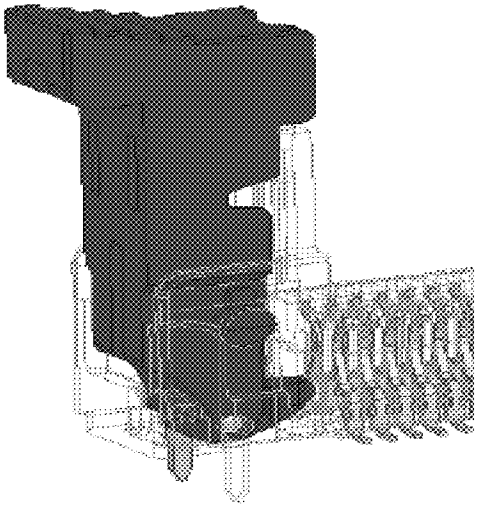
Figure 5B:
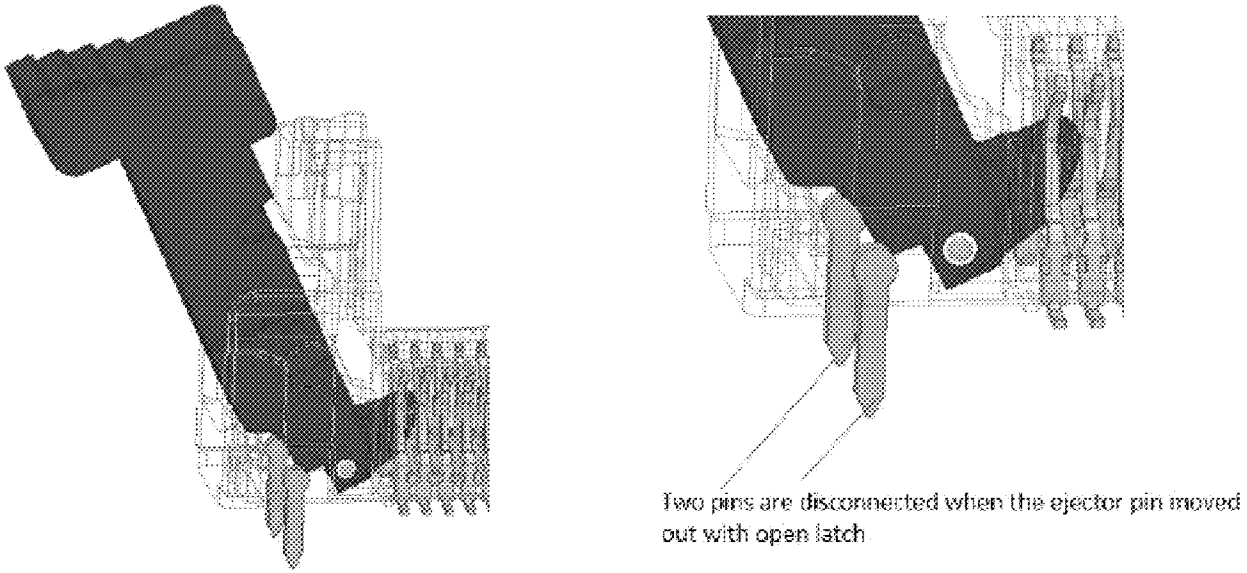

FIGS. 5*a* and 5*b* show detailed views of an embodiment of the solution of FIGS. 3*a* and 3*b;*

Figure 6A:
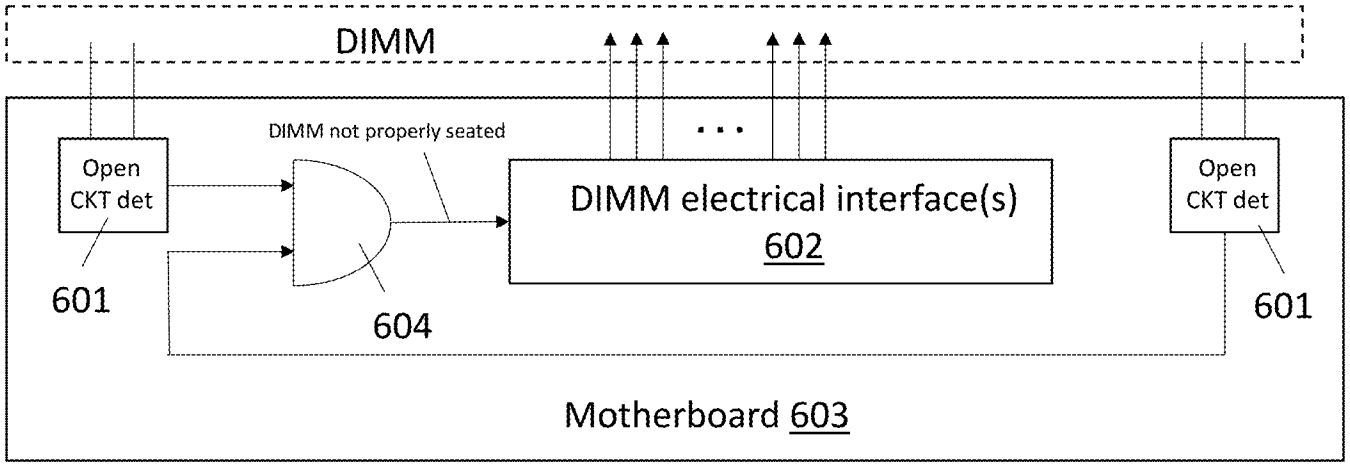
Figure 6B:
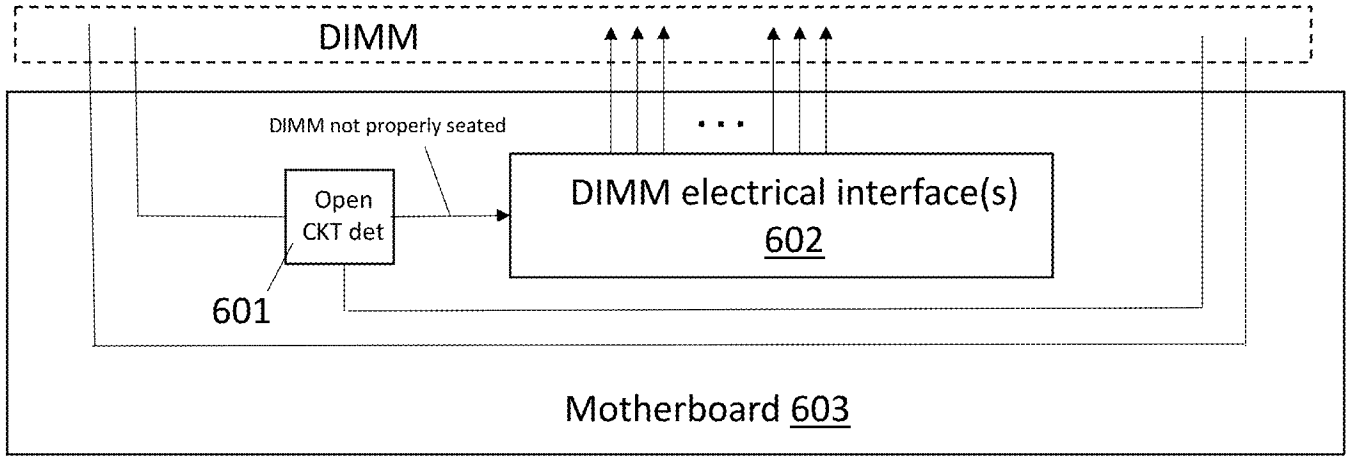

FIGS. 6*a* and 6*b* show different motherboard embodiments that are designed to implement the solution of FIGS. 3*a* and 3*b;*

Figure 7:
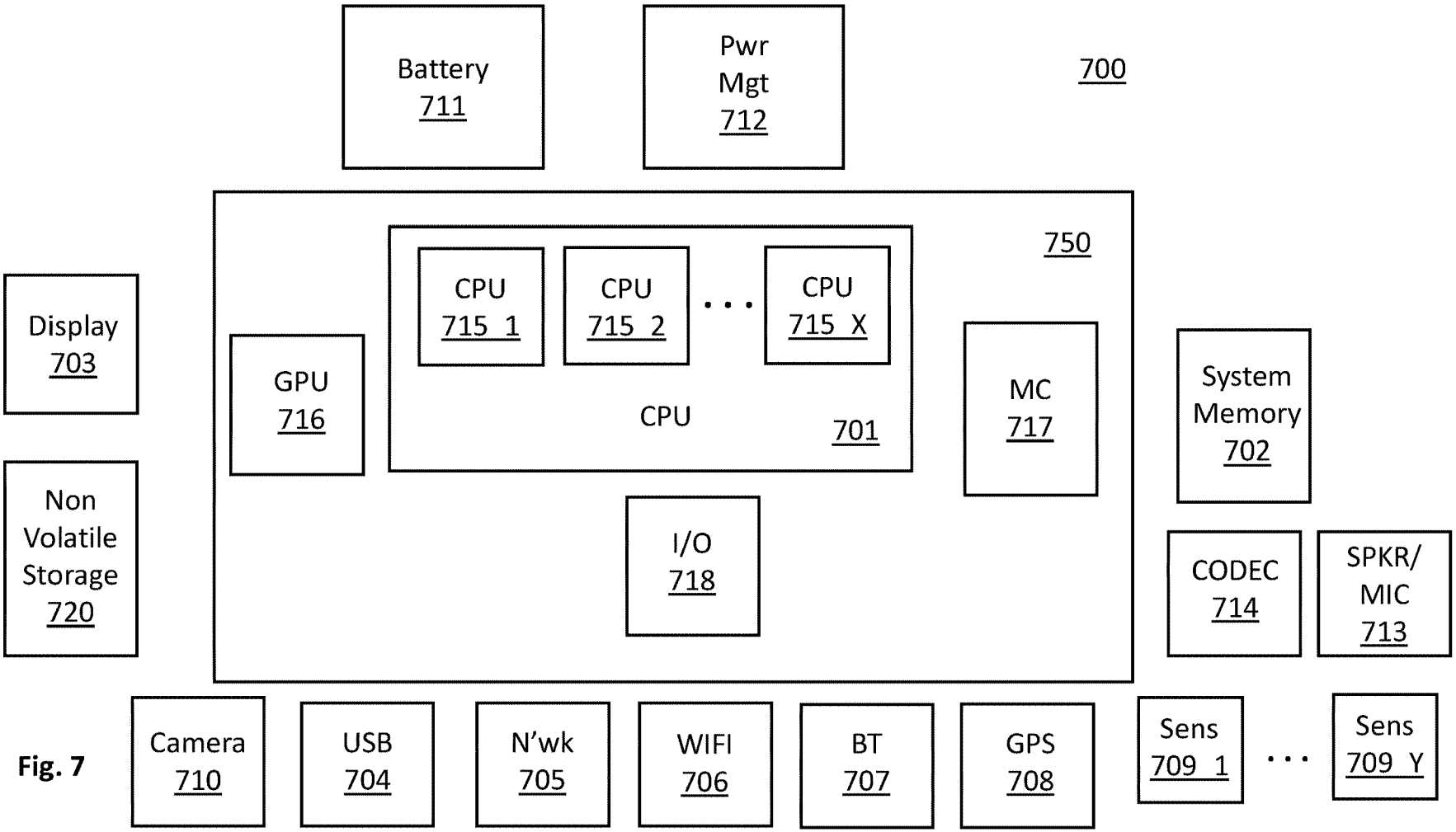

FIG. 7 shows a computing system.

DETAILED DESCRIPTION

FIGS. 1*a*, 1*b* and 1*c* depict a standard DIMM/motherboard attachment mechanism. As observed in FIG. 1*a*, a socket housing 101 having an integrated release latch 102 on each side of the socket housing 101 is mounted to a motherboard 103. I/O pins point upward from the bottom of the socket housing 101 and mate to openings in the bottom of the DIMM's connector element 104. As the DIMM is pressed into the socket housing 101, referring to FIG. 1*b*, the lever arms of the release latches 102 close and remain in the closed position while the DIMM is securely mounted to the socket housing 101 and motherboard 103.

In order to release the DIMM from the socket housing 101, referring to FIG. 1*c*, a user pushes the lever arms outward which rotates the latches and pushes the bottom of the DIMM upward thereby releasing the mechanical connection between the socket pins and the openings at the bottom of the DIMM connector element 104.

A failure mechanism has been discovered with respect to the DIMM/socket connection of a Joint Electron Device Engineering Council (JEDEC) Dual Data Rate 5 (DDR5) memory implementation. In particular, the overall mechanical design appears to be susceptible to shocks that causes, at least in some cases, rotation of the DIMM while the DIMM is latched into the socket which, in turn, can cause mechanical damage to the I/O pins of the socket housing.

FIG. 2 shows a zoom-in of the problem in more detail. As observed in FIG. 2, subtle rotation of the DIMM, e.g., in response to a shock, causes a corner of the DIMM (not shown) to at least partially pull out of the socket. The rotation, in turn, causes the opposite corner of the DIMM (depicted in FIG. 2) to rotate within the socket. The rotation of the DIMM corner within the socket can bend pins at the far end of the I/O pin array. In some cases a bent pin will touch a neighboring pin, where, the two pins provide different voltages. For example, a first pin having a Vin_BULK voltage could touch a second pin having a PWR_GOOD voltage.

Importantly, the touching of these two voltage pins can damage the circuitry on the motherboard that provides these voltages. That is, the subtle rotation of the DIMM in the socket can result in a damaged motherboard, which, in turn results not only in a failure of a larger computing system, but also, the computer system's most expensive component.

A solution is to integrate some special, additional functionality into the DIMM/socket connection that can detect when the DIMM is misaligned in the socket as described above, and, turn off (and/or keep off) at least the critical voltages (e.g., Vin_BULK, PWR_GOOD), if not all voltages, by the motherboard thereby protecting the circuitry on the motherboard that provides these voltages.

FIGS. 3*a* and 3*b* therefore show a solution the integrates a circuit into the DIMM/socket connection so as to achieve the above described functionality. FIG. 3*a* depicts when the DIMM is properly mounted in the socket. FIG. 3*b* shows, e.g., after a shock, when the DIMM has rotated and a corner of the DIMM has at least partially out of the socket. In particular, note that the lever arm of the latch 302 where the DIMM has rotated out of the socket rotates/flares outward as the release finger (also referred to as an "ejector") rotates into the space between the DIMM and exposed pins. That is, partial removal of a DIMM corner from its socket translates into motion (rotation) of the latch at the same DIMM corner. Here, the latch is commonly hinged relative to its center of mass to naturally rotate to the open position as a steady state when there is no DIMM connector element present.

The solution therefore uses the aforementioned rotation/movement of the latch 302 to trigger the generation of a warning signal that the DIMM is misaligned in the socket. In particular, an electrical circuit is integrated into the latch 302 that is closed when the DIMM is properly seated (FIG. 3*a*) but opens when the release ejector exhibits movement into the space between the socket housing and the DIMM (FIG. 3*b*).

Here, in the case of FIG. 3*a* when the DIMM is properly seated and the circuit is closed, a voltage or current is free to run through the connection which circuitry on the motherboard can generate and detect. By contrast, when the DIMM partially rotates out of the socket, as depicted in FIG. 3*b*, the circuit is electrically open. In this state, any voltage that is applied by the motherboard at one of the circuit will not be present at the other end of the circuit, and/or, any current that is made to flow through the circuit by the motherboard will not flow through either end of the circuit. Either situation can easily be detected by circuitry on the motherboard. In response to detection of an open circuit condition as in FIG. 3*b*, the circuitry on the motherboard can refuse to apply any/all voltages to the DIMM.

FIGS. 4*a* and 4*b* shows features of a latch ejector (FIG. 4*a*) and socket housing (FIG. 4*b*) that are enhanced to effect a circuit as described above. As observed in FIG. 4*a*, a "pin" 410 is integrated into the latch ejector that runs widthwise from one side of the ejector to the other side of the ejector. The cross sectional face at each end of the pin is exposed at each side of the ejector thereby creating contacts for one element of the circuit. The other elements of the circuit, referring to FIG. 4*b*, are implemented as pins 411 that run along the inner faces of the socket housing that interface with the latch into the motherboard. At least a portion of both of these pins 411 are exposed to make contact to the pin 410 that is embedded in the ejector. The socket pins 411 that are integrated into a location of the socket such that the pins 411 will make physical contact with the pin 410 that is embedded in the finger when the DIMM is properly seated in the socket.

FIGS. 5*a* and 5*b* show the design in more detail. As observed in FIG. 5*a*, when the DIMM is properly seated, the latch is pushed away from the DIMM/socket interface by the DIMM (no space exists between the DIMM and the socket). In this position, the pin in the latch is aligned with and makes physical/electrical contact to both pins in the socket housing. With the pin in the latch making contact to both pins in the housing, a closed circuit runs from one of the socket pins, through the latch pin, to the other of the socket pins. In this state any voltage and/or current that is placed on one of the socket pins by the motherboard will be observed at the other of the sockets pins.

By contrast, as observed in FIG. 5*b*, when the DIMM rotates and is at least partially released from the corner of the socket, the latch rotates into the space that is created between the DIMM and socket pins. The rotation of the latch causes the pin that is embedded in the latch to move and lose physical contact with the pins that are embedded in the housing. The loss of contact from the movement opens the circuit that once existed in the socket and ejector. The opening of the circuit prevents any voltage/current that is presented to the circuit by the motherboard to be disrupted, which, in turn, the motherboard can detect. Thus, in response to such detection, the motherboard can refuse to send various voltages to the socket pins to protect the motherboard against shorts between such voltages should various socket pins have been bent by the unseating of the DIMM corner.

FIGS. 6*a* and 6*b* show two possible electrical designs for the motherboard 603. According to a first embodiment depicted in FIG. 6*a*, there is an open circuit detection circuit 601 for each corner of the DIMM. A logic gate 604 receives a signal from both of the open detection circuits 601 and if either of the circuits 601 indicates an open circuit, the logic gate sends a signal to interface circuitry 602 that sends one or more voltages to the DIMM that causes the interface circuitry 602 to suppress the sending of the one or more voltages to the DIMM. In the approach of FIG. 6*b*, the circuits that flow through the DIMM connection are daisy chained into a single series circuit that requires only one open circuit detection circuit 601. Note that the open detection circuit 601 in either implementation is designed to generate a test voltage and/or current and sense whether the voltage and/or current is disrupted by an open circuit in the DIMM/socket circuit.

Although embodiments above have stressed a design in which the closed circuit corresponds to proper alignment of the DIMM and the open circuit corresponds to improper alignment of the DIMM, there can exist alternative embodiments where the closed circuit corresponds to improper alignment of the DIMM and the open circuit corresponds to proper alignment of the DIMM.

FIG. 7 provides an exemplary depiction of a computing system 700. Any of the aforementioned cloud services can be constructed, e.g., from networked clusters of computers having at least some of the components described below and/or networked clusters of such components.

As observed in FIG. 7, the basic computing system 700 may include a central processing unit (CPU) 701 (which may include, e.g., a plurality of general purpose processing cores 715_1 through 715_X) and a main memory controller 717 disposed on a multi-core processor or applications processor, main memory 702 (also referred to as "system memory"), a display 703 (e.g., touchscreen, flat-panel), a local wired point-to-point link (e.g., universal serial bus (USB)) interface 704, a peripheral control hub (PCH) 718; various network I/O functions 705 (such as an Ethernet interface and/or cellular modem subsystem), a wireless local area network (e.g., WiFi) interface 706, a wireless point-to-point link (e.g., Bluetooth) interface 707 and a Global Positioning System interface 708, various sensors 709_1 through 709_Y, one or more cameras 710, a battery 711, a power management control unit 712, a speaker and microphone 713 and an audio coder/decoder 714.

An applications processor or multi-core processor 750 may include one or more general purpose processing cores 715 within its CPU 701, one or more graphical processing units 716, a main memory controller 717 and a peripheral control hub (PCH) 718 (also referred to as I/O controller and the like). The general purpose processing cores 715 typically execute the operating system and application software of the computing system. The graphics processing unit 716 typically executes graphics intensive functions to, e.g., generate graphics information that is presented on the display 703. The main memory controller 717 interfaces with the main memory 702 to write/read data to/from main memory 702. The power management control unit 712 generally controls the power consumption of the system 700. The peripheral control hub 718 manages communications between the computer's processors and memory and the I/O (peripheral) devices.

Each of the touchscreen display 703, the communication interfaces 704-707, the GPS interface 708, the sensors 709, the camera(s) 710, and the speaker/microphone codec 713, 714 all can be viewed as various forms of I/O (input and/or output) relative to the overall computing system including, where appropriate, an integrated peripheral device as well (e.g., the one or more cameras 710). Depending on implementation, various ones of these I/O components may be integrated on the applications processor/multi-core processor 750 or may be located off the die or outside the package of the applications processor/multi-core processor 750. The computing system also includes non-volatile mass storage 720 which may be the mass storage component of the system which may be composed of one or more non-volatile mass storage devices (e.g. hard disk drive, solid state drive, etc.). The non-volatile mass storage 720 may be implemented with any of solid state drives (SSDs), hard disk drive (HDDs), etc. To the extent the mass storage includes SSDs, or other types of semiconductor based storage.

The main memory, storage and/or other memory may be implemented with a DIMM connection mechanism having an integrated DIMM alignment detection circuit as described at length above.

Embodiments of the invention may include various processes as set forth above. The processes may be embodied in program code (e.g., machine-executable instructions). The program code, when processed, causes a general-purpose or special-purpose processor to perform the program code's processes. Alternatively, these processes may be performed by specific/custom hardware components that contain hard interconnected logic circuitry (e.g., application specific integrated circuit (ASIC) logic circuitry) or programmable logic circuitry (e.g., field programmable gate array (FPGA) logic circuitry, programmable logic device (PLD) logic circuitry) for performing the processes, or by any combination of program code and logic circuitry.

An apparatus is described. The apparatus includes a dual-in line memory module (DIMM) socket having a first electrical circuit component embedded in a latch of the DIMM socket. The first electrical circuit component has a first exposed electrical contact that is to contact or not contact a second exposed electrical contact of a second electrical circuit component that is embedded in a housing of the socket depending on whether a corner of a DIMM is or is not properly inserted into the DIMM socket.

A computing system has been described. The computing system includes a plurality of processing cores; a network interface; a memory controller; and a memory coupled to the memory controller. The memory has a dual-in line memory module (DIMM) socket having a first electrical circuit component embedded in a latch of the DIMM socket. The first electrical circuit component has a first exposed electrical contact that is to contact or not contact a second exposed electrical contact of a second electrical circuit component that is embedded in a housing of the socket depending on whether a corner of a DIMM is or is not properly inserted into the DIMM socket.

The second electrical circuit component can extend out of the DIMM socket to form a connection to a motherboard. The first electrical circuit component can be embedded in an ejector of the latch. The first electrical circuit component can be a pin. The first electrical circuit component can include a third exposed electrical contact that is to contact or not contact a fourth exposed electrical contact of a third electrical circuit component that is embedded in the housing of the socket depending on whether the corner of the DIMM is or is not properly inserted into the DIMM socket. The first electrical circuit component can be embedded in an ejector of the latch and the second and third exposed electrical contacts can be positioned to face opposite sides of the latch. The first and second exposed electrical contacts can make contact when the corner of the DIMM is properly inserted into the DIMM socket.

A method is described. The method includes detecting if a corner of a dual in line memory module (DIMM) is properly inserted into a DIMM socket by detecting whether an open or closed state exists in a circuit having circuit elements formed in the DIMM socket.

The circuit elements can include a first circuit element that is embedded in a latch of the DIMM socket and a second circuit element that is embedded in a housing of the DIMM socket. The first circuit element can be embedded in an ejector of the latch. The first circuit element can be a pin. The method can further include refusing to send at least one voltage to the DIMM if the corner of the DIMM is not detected to be properly inserted into the DIMM socket. The method can further include detecting if an opposite corner of the DIMM is properly inserted into the DIMM socket by an open or closed state in a second circuit having circuit elements formed in the DIMM socket.

Elements of the present invention may also be provided as a machine-readable medium for storing the program code. The machine-readable medium can include, but is not limited to, floppy diskettes, optical disks, CD-ROMs, and magneto-optical disks, FLASH memory, ROMs, RAMs, EPROMs, EEPROMs, magnetic or optical cards or other type of media/machine-readable medium suitable for storing electronic instructions.

In the foregoing specification, the invention has been described with reference to specific exemplary embodiments thereof. It will, however, be evident that various modifications and changes may be made thereto without departing from the broader spirit and scope of the invention as set forth in the appended claims. The specification and drawings are, accordingly, to be regarded in an illustrative rather than a restrictive sense.

The invention claimed is:

1. An apparatus, comprising:

a dual-in line memory module (DIMM) socket comprising a first electrical circuit component embedded in a latch of the DIMM socket, the first electrical circuit component having a first exposed electrical contact that is to contact or not contact a second exposed electrical contact of a second electrical circuit component that is embedded in a housing of the socket depending on whether a corner of a DIMM is or is not properly inserted into the DIMM socket.

2. The apparatus of claim 1 wherein the second electrical circuit component extends out of the DIMM socket to form a connection to a motherboard.

3. The apparatus of claim 1 wherein the first electrical circuit component further comprises a third exposed electrical contact that is to contact or not contact a fourth exposed electrical contact of a third electrical circuit component that is embedded in the housing of the socket depending on whether the corner of the DIMM is or is not properly inserted into the DIMM socket.

4. The apparatus of claim 1 wherein the first and second exposed electrical contacts are to make contact when the corner of the DIMM is properly inserted into the DIMM socket.

5. The apparatus of claim 1 wherein the first electrical circuit component is embedded in an ejector of the latch.

6. The apparatus of claim 5 wherein the first electrical circuit component is a pin.

7. The apparatus of claim 6 wherein the first electrical circuit component is embedded in an ejector of the latch and the second and third exposed electrical contacts are positioned to face opposite sides of the latch.

8. A computing system, comprising:

a plurality of processing cores;

a network interface;

a memory controller; and, a memory coupled to the memory controller, the memory comprising a dual-in line memory module (DIMM) socket comprising a first electrical circuit component embedded in a latch of the DIMM socket, the first electrical circuit component having a first exposed electrical contact that is to contact or not contact a second exposed electrical contact of a second electrical circuit component that is embedded in a housing of the socket depending on whether a corner of a DIMM is or is not properly inserted into the DIMM socket.

9. The computing system of claim 8 wherein the second electrical circuit component extends out of the DIMM socket to form a connection to a motherboard.

10. The computing system of claim 8 wherein the first electrical circuit component further comprises a third exposed electrical contact that is to contact or not contact a fourth exposed electrical contact of a third electrical circuit component that is embedded in the housing of the socket depending on whether the corner of the DIMM is or is not properly inserted into the DIMM socket.

11. The computing system of claim 8 wherein the first and second exposed electrical contacts are to make contact when the corner of the DIMM is properly inserted into the DIMM socket.

12. The computing system of claim 8 wherein the DIMM socket is mounted to a motherboard and the motherboard comprises circuitry coupled to the second electrical circuit component, the circuit to determine whether a closed circuit exists through a circuit formed with the first electrical circuit component and the second electrical circuit component.

13. The computing system of claim 8 wherein the first electrical circuit component is embedded in an ejector of the latch.

14. The computing system of claim 13 wherein the first electrical circuit component is a pin.

15. The computing system of claim 14 wherein the first electrical circuit component is embedded in an ejector of the latch and the second and third exposed electrical contacts are positioned to face opposite sides of the latch.

16. A method, comprising:

detecting if a corner of a dual in line memory module (DIMM) is properly inserted into a DIMM socket by detecting whether an open or closed state exists in a circuit comprising circuit elements formed in the DIMM socket;

wherein the circuit elements comprise a first circuit element that is embedded in a latch of the DIMM socket and a second circuit element that is embedded in a housing of the DIMM socket.

17. The method of claim 16, wherein the first circuit element is embedded in an ejector of the latch.

18. The method of claim 16 further comprising refusing to send at least one voltage to the DIMM if the corner of the DIMM is not detected to be properly inserted into the DIMM socket.

19. The method of claim 16 further comprising detecting if an opposite corner of the DIMM is properly inserted into the DIMM socket by an open or closed state in a second circuit comprising circuit elements formed in the DIMM socket.

* * * * *